US005619580A

United States Patent [19]

Hansen

[11] Patent Number: 5,619,580

[45] Date of Patent: Apr. 8, 1997

[54] HEARING AID COMPENSATING FOR ACOUSTIC FEEDBACK

[75] Inventor: Roy S. Hansen, Dragør, Denmark

[73] Assignee: GN Danovox A/S, Taustrup, Denmark

[21] Appl. No.: 338,577

[22] PCT Filed: Oct. 8, 1993

[86] PCT No.: PCT/DK93/00332

§ 371 Date: Apr. 13, 1995

§ 102(e) Date: Apr. 13, 1995

[87] PCT Pub. No.: WO94/09604

PCT Pub. Date: Apr. 28, 1994

[30] Foreign Application Priority Data

Oct. 20, 1992 [DK] Denmark ..... 1282/92

[51] Int. Cl.[6] ..... H04R 25/00

[52] U.S. Cl. ..... 381/68.2; 381/68; 381/68.4

[58] Field of Search ..... 381/68.2, 68.4, 381/83, 93, 68; 364/724.17, 724.19

[56] References Cited

U.S. PATENT DOCUMENTS 4,453,039 6/1984 Ferrieu .
5,091,952 2/1992 Williamson et al. ..... 381/68.2
5,206,911 4/1993 Eriksson et al. ..... 381/71
5,259,033 11/1993 Goodings et al. ..... 381/83

FOREIGN PATENT DOCUMENTS 0415677 3/1991 European Pat. Off. .
4026420 2/1991 Germany .
WO90/05436 5/1990 WIPO .

*Primary Examiner*—Curtis Kuntz
*Assistant Examiner*—Duc Nguyen
*Attorney, Agent, or Firm*—Merchant, Gould, Smith, Edell, Welter & Schmidt, P.A.

[57] ABSTRACT

A hearing aid with digital, electronic compensation for acoustic feedback comprises a microphone (5), a preamplifier (7), a digital compensation circuit (3), an output amplifier (9) and a transducer (11). The digital circuit (3) comprises a noise generator (33) for the insertion of noise, and an adjustable, digital filter (27) for the adaptation of the feedback signal. The adaptation takes place using a correlation circuit (31). The circuit further comprises a digital circuit (210) which monitors the loop gain and regulates the hearing aid amplification via a digital summing circuit (211), so that the loop gain is less than a constant K. The circuit further comprises a digital circuit (79) which carries out a statistical evaluation of the filter coefficients in the correlation circuit, and changes the feedback function in accordance with this evaluation.

3 Claims, 2 Drawing Sheets

HEARING AID COMPENSATING FOR ACOUSTIC FEEDBACK

TECHNICAL FIELD

The invention concerns a digital hearing aid as disclosed in more detail in the preamble to claim 1.

A hearing aid of this kind with digital suppression of or compensation for acoustic feedback is known from the applicant's earlier European patent application no. 90309342.5 (publication no. EP-A2-0415677).

Such a hearing aid has in practice proved to function as intended. In order for the hearing aid not to oscillate, the compensation, which is carried out by updating the coefficients in a digital filter in a feedback circuit, is effected by means of an algorithm which takes into account the error in the filter, i.e. the difference between the filter's actual setting and the desired setting. Such a hearing aid will not always be quick enough to adapt to sudden changes in the acoustic feedback path, even though it is still able to compensate for the acoustic feedback which arises. The lack of speed in the adaptation function can result in undesired acoustic signals which can be heard by the user of the hearing aid.

Hearing aid designs of the kind disclosed in the preamble to claim 1 are known from U.S. Pat. Nos. 4,453,039 and 5,091,952, wherein the amplification in the hearing aid is regulated depending on the loop gain, so that the amplification is reduced so much that the hearing aid does not start to oscillate. The disadvantage of this is that in some cases the amplification is regulated downwards to such a degree that this becomes inexpedient for the user.

In order to increase the adaptation speed without the hearing aid beginning to oscillate, the algorithm which takes care of the updating of the coefficients in the digital filter in the compensation circuit must take into consideration that the filter error depends on a number of coefficients, signal/noise ratio, input level, volume, and on the degree of peak clipping in the limiter circuit. Such an embracing algorithm will not be particularly fast in adapting itself to changes in the acoustic feedback path, but on the other hand it will provide a reliable and precise adjustment of the filter under stationary conditions in the feedback path.

When it has been ascertained that an important change is in progress, i.e. that a significant change has occurred in the acoustic feedback path, the circuit automatically effects a changeover of the algorithm in order to increase the speed of adaptation, e.g. by adding more noise and/or increasing the speed of adaptation in excess of what is prescribed by the basic algorithm. The quick condition lasts until the circuit ascertains that the filter coefficients are stable again, after which the circuit automatically switches back to the basic algorithm for continuous adjustment of the electronic compensation.

Such an apparatus is disclosed in Danish patent application no. 432/92 filed on Mar. 31, 1992 (=PCT/DK93/00106).

In a hearing aid with digital compensation for acoustic feedback, it will be possible to achieve an increased maximum amplification. If the hearing aid has already been adjusted to provide a given amplification, e.g. by the user, the extra amplification which the hearing aid can provide, because it has compensation for acoustic feedback, can perhaps be so great that the regulation system cannot compensate for a sudden increased level in the feedback path, and the apparatus will oscillate until it is screwed down or until the amplication in the feedback path is reduced. This can be of inconvenience for the user.

ADVANTAGES OF THE INVENTION

The object of the present invention is to avoid that a hearing aid with compensation for acoustic feedback, and of the kind disclosed in the preample to claim 1, can start to oscillate, in that the apparatus is arranged in such a manner that it automatically reduces the amplification if a sudden increase of the level in the feedback path arises. As soon as the condition with increased level in the feedback path ceases, the hearing aid's amplification will automatically be adjusted back to the level which has been selected by the user.

This is achieved by configuring the hearing aid according to the invention as characterized in claim 1.

The circuit carries out the control by continuously calculating the amplification in the adaptive filter at different frequencies, and at the same time herewith the circuit monitors the setting of the volume control, and on this basis regulates the hearing aid's loop gain so that it is always less than a constant K, where $K \geqq 1$. K is a constant or a function of the frequency. The hearing aid's FIR filter is able to provide extra amplification at high frequencies. If the total loop gain is greater than or equal to K, the amplification is reduced, possibly down to a lower level than that set by the user.

This form of regulation can be used with great advantage in connection with a hearing aid which is arranged as disclosed in Danish patent application no. 432/92 (PCT/DK93/00106), and as disclosed in the preamble to claim 1, so that an optimized compensation for acoustic feedback is achieved. Consequently, the resulting hearing aid is one which always gives the user the optimum possible amplification, while at the same time strongly reducing the hearing aid's tendency to oscillate.

Claim 2 discloses an advantageous embodiment of the invention.

THE DRAWING

The invention will now be described in more detail with reference to the drawing, in that FIG. 1 shows a block diagram of a hearing aid according to Danish patent application no. 432/92, and FIG. 2 shows the hearing aid in FIG. 1, but further provided with the regulation circuit according to the invention.

DESCRIPTION OF THE PREFERRED EMBODIMENT

Figure 1:
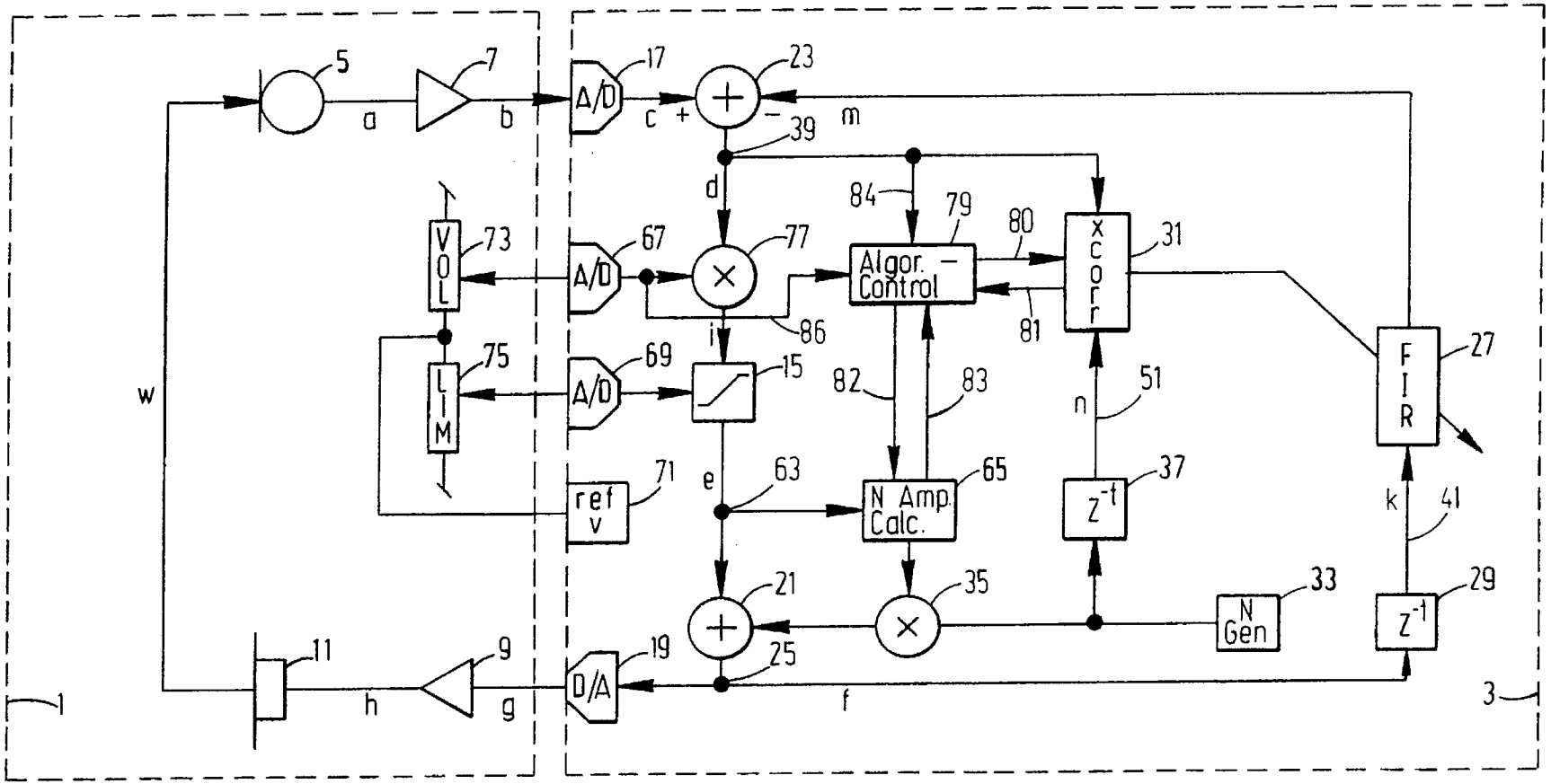
Figure 2:
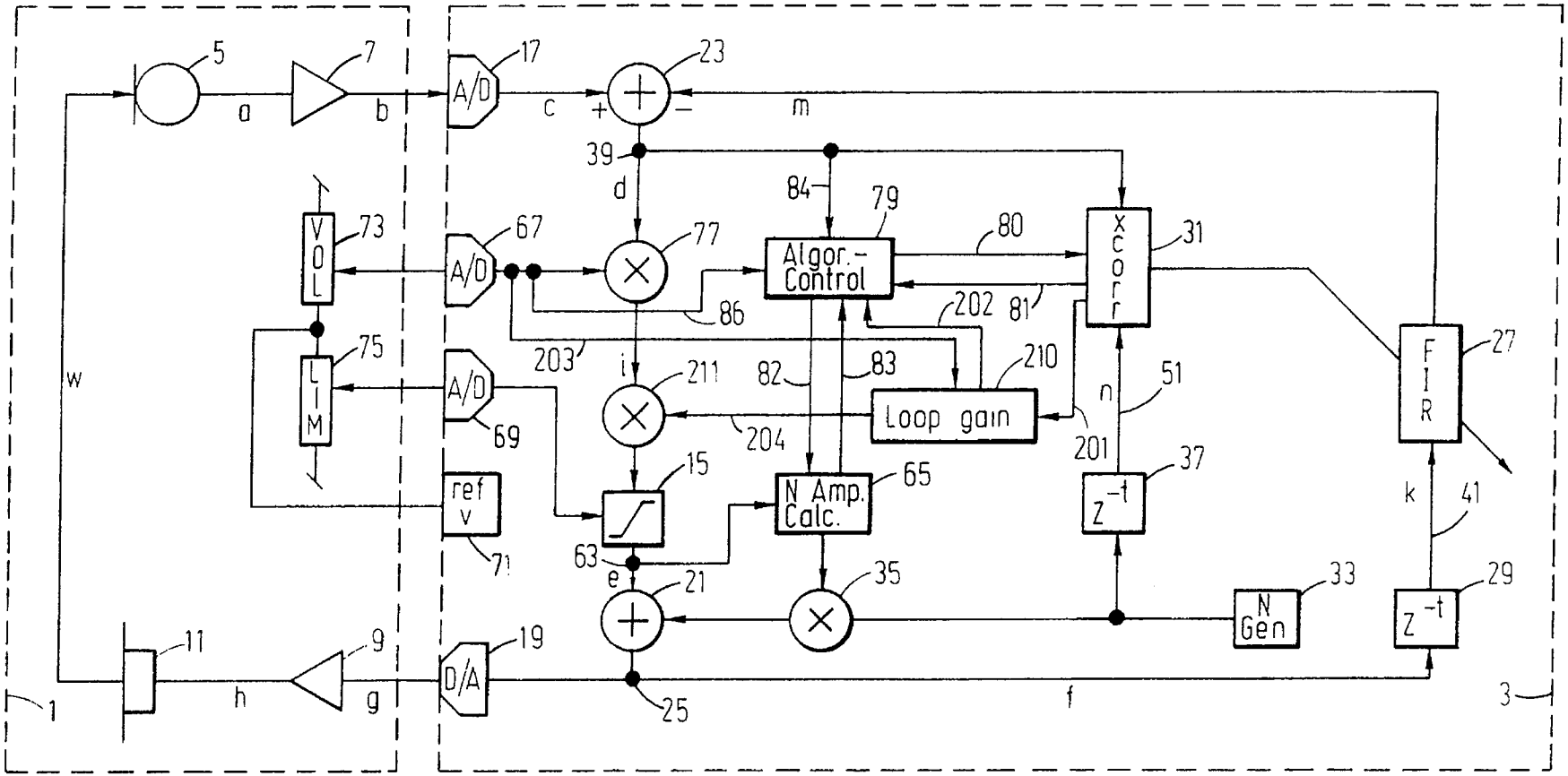

The following description of the preferred embodiment of the invention, with reference to FIGS. 1 and 2 of the drawing, is only an example of how the invention can be utilized in practice. In all of the figures of the drawing, the same reference designations are used for identical components or circuits etc.

FIG. 1 shows the hearing aid which is disclosed and described as the preferred embodiment in Danish patent application no. 432/92, and for this reason a number of the part-circuits are not explained more fully in the present application.

In FIG. 1 is shown a hearing aid comprising a sound receiver, for example in the form of a microphone 5, a preamplifier 7, a digital adaptation circuit 3, an output amplifier 9 and a sound reproducer 11, for example a miniature electro-acoustic transducer.

The preamplifier 7 is of a commonly-known type, for example of the type known from the applicant's earlier European application no. 90309342.5, and the output amplifier 9 is similarly of a commonly-known type, for example corresponding to the output amplifier which is used in the hearing aid in the applicant's earlier European application no. 90309342.5.

The digital adaptation circuit 3 is shown within the stippled frame in the connection between the preamplifier 7 and the output amplifier 9. However, there is nothing to prevent the circuit 3 from being a mixed analogue and/or digital circuit, but in the preferred embodiment a purely digital circuit is used.

The input to the digital adaptive circuit 3 comprises an A/D converter 17 and the output from the circuit comprises a D/A converter 19. In the circuit path c, d, i, e and f between the input 17 and the output 19 there is a digital limiter circuit 15 of a known kind, for example as known from the applicant's earlier European application no. 90309342.5. The function of the limiter circuit 15 is to prevent the electrical signal from reaching a level of amplitude which exceeds the linearity limits of the output amplifier 9 and the transducer 11, and as explained in said European application.

A digital summing circuit 21 is inserted in the path between the limiter circuit 15 and the D/A converter 19. The summing circuit 21 serves as a place for the introduction of a noise signal N as explained later. A digital subtraction circuit 23 is inserted in the path between the A/D converter 17 and the limiter circuit 15. The subtraction circuit 23 comprises means for the introduction of electrical feedback, as will also be described later.

The normal signal path for a desired signal from the microphone 5 to the transducer 11 is the direct circuit path a-b-c-d-i-e-f-g-h as shown in FIG. 1. It should be noted that the electrical path a, b, g and h is arranged for analogue signals and thus normally comprises only a single conductor, while the electrical signal path c, d, i, e and f is arranged for digital signals and will thus comprise a number of parallel conductors, for example 8 or 12 conductors, depending on the bit number from the A/D converter 17.

Electrical feedback is derived from a tap 25 in section f in the digital signal path between the summing circuit 21 and the D/A converter 19, which means that the electrical, digital feedback signal comprises a noise-level component. The feedback signal is led through an adaptive filter 27 which is shown as a "limited impulse response filter", a so-called FIR filter (Finite-Impulse-Response filter), and after passing through this filter, the feedback signal is fed to the digital subtraction circuit 23 via a digital signal path m. Preferably, the digital signal from the tap 25 is fed via a delay circuit 29 before being fed to the FIR filter 27 as a digital signal 41 via the digital lead k. The delay in the delay circuit 29 is of the same order as the minimum acoustic path length between the transducer 11 and the microphone 5, and must introduce a delay which corresponds hereto. It is not necessary to introduce such a delay by means of the delay circuit 29, but significant redundancy in filters and correlation circuits is hereby avoided, so that the overall circuit is simplified. The impulse response from the filter 27 is continuously adjusted, controlled by coefficients from a correlation circuit 31. The correlation circuit constantly seeks for correlation between the inserted digital noise and any noise component in the residual signal in the connection d after the digital subtraction circuit 23. The inserted noise signal N is generated from a noise source 33 and is introduced via the digital summing circuit 21 after level adjustment in the regulation circuit 35. The noise signal is also coupled to a reference input on the correlation circuit 31 via a second delay circuit 37, which also introduces a delay of the same order as the minimum acoustic path length between the transducer 11 and the microphone 5 via the signal path n. The residual signal on the lead d constitutes the input signal on the correlation circuit 31, in that the signal is fed hereto from a point 39 on the lead d and by means of a digital lead.

In addition to the above, there is inserted a circuit 79 in the form of an algorithm control circuit which determines the algorithm in accordance with which the correlation circuit 31 must send coefficients further to the filter 27, in that the algorithm control circuit 79, via the digital connections 80, 81, constantly monitors and controls the correlation circuit 31. The algorithm control circuit 79 also controls the supply of digital noise from the noise generator 33 by regulating the level in the circuit 35 via the leads 82 and a digital calculation unit 65. Moreover, the residual signal is fetched from the tap 39 via the lead 84, the amplitude of the noise signal is fetched via the lead 83, and the volume signal is fetched via the lead 86, which is explained later.

The electrical output signal from point 25 is thus fed via the delay circuit 29 to the adaptive filter 27 (FIR), and to the subtraction circuit 23 as the final feedback signal, where the subtraction from the input signal is carried out.

In an optimum situation, the feedback signal will correspond completely to an undesired acoustic feedback signal which, via a feedback path w, is conducted from the transducer 11 to the microphone 5. If the feedback signal and the signal from the acoustic feedback are completely identical, there will be no residual signal from the acoustic feedback on the lead d, the reason being that the digital feedback signal from the lead m will completely cancel out the acoustic feedback signal.

In order for the filter 27 to be able to be set correctly, the noise signal N is added to the output signal via the summing circuit 21 after level regulation in the circuit 35. The noise signal will thus exist in both the inner feedback circuit 3 and the outer acoustic feedback path w. The noise signal will thus pass the D/A converter 19 and, via the amplifier 9, reach the transducer 11 and be converted to an acoustic signal which is superimposed on the desired signal. The level of the noise signal is set in such a manner that it is of no inconvenience to the user of the hearing aid.

In practice, the two said signals do not cancel each other out completely, and a small amount of noise and other feedback signals are to be found in the residual signal on the digital lead d, and these are detected by the correlation circuit 31 which constantly looks for correlation between the residual signal and the delayed version of the noise signal n. The output signal from the correlation circuit 31 is an expression for the residual signal, and is used for controlling the filter 27 by changing the filter coefficients. The adaptation is thus arranged that the filter 27 is constantly adjusted so that the feedback system seeks towards a situation in which the noise is cancelled. Physical changes in the environment for the hearing aid and its user, and limitations in the algorithm which controls the system, give rise to the result that complete cancellation cannot always be achieved, which is why the algorithm control circuit 79 is inserted.

Further details of a hearing aid according to the invention shown in FIG. 1 of the drawing, and comprising a user-operated volume control 73 and a similarly user-operated adjustment rheostsat 75 for the setting of the level in the limiter circuit 15.

In a hearing aid there is normally a volume control which can be operated by the user. This can be placed in the microphone amplifier or in front of the output amplifier, but in both cases the adaptive filter 27 must change its coefficients when the setting of the volume control is changed. In FIG. 1 is shown a multiplication amplifier 77 between the tap 39 and the amplitude limiting circuit 15. The amplifier 77 is coupled to the volume control 73 via an A/D converter 67, and from the input to the amplifier 77 there is a digital lead 86 for the algorithm control circuit 79 so that this circuit can scan the volume setting.

The amplitude limiter 15 can also be user-operated, in that the potentiometer 75 is coupled to the amplifier 15 via an A/D converter 69. It is desirable that the limiter 15 is user-operated, since the limiting circuit determines the maximum sound-pressure level which can be applied to the user's ear. The output level can be reduced without reducing the gain of the amplifier, which is of significance. The maximum positive and negative sound pressure is thus regulated by the user with the potentiometer 75. FIG. 1 also shows that the two potentiometers 73 and 75 are connected to a common source of reference voltage 71.

As mentioned above, the level of the inserted noise can be regulated to obtain optimum adaptation. In FIG. 1 it is seen that the amplifier 35 after the noise generator 33 is controlled by a computation unit 65, for example in the form of a single-stage recursive filter. The unit 65 is coupled via the two-way connection 82, 83 to the algorithm control unit 79, so that the unit 79 can fetch the noise amplitude from the unit 65, and such that the signal/noise ratio can be regulated by the algorithm control unit 79.

In order to be sure that the hearing aid with built-in digital feedback does not begin to oscillate of its own accord, it must be ensured that the updating in the correlation circuit 31 is effected on the basis of an algorithm which takes into consideration that errors in the filter depend upon: The number of coefficients, signal/noise ratio, input level, the volume and the extent to which the signal is peak clipped, which is explained in more detail in the applicant's earlier application no. 432/92.

FIG. 2 shows the same hearing aid as FIG. 1, but the circuit comprises a further digital circuit 210, the function of which is to measure and calculate the loop gain, and to regulate the hearing aid's amplification if this is greater than or equal to K. A digital multiplication circuit 211 for the regulation of the hearing aid's amplification is introduced before the amplification limiting circuit 15 and after the digital multiplication circuit 77.

The circuit 210 receives information concerning the filter coefficients from the correlation circuit 31, and information concerning the setting of the user-operated volume control 73, in that the digital output signal from the A/D converter 67 is led to the additional digital circuit 210 via the digital lead 203.

At a number of frequencies, the digital circuit 210 carries out a calculation of the loop gain, and controls the algorithm control circuit 79 by means of the digital lead 202, and also increases or reduces the amplification by multiplying digital values via the multiplication circuit 211.

If it is possible, due to the digital feedback circuit in FIG. 1, to achieve an increased maximum amplification of 15 dB, the situation during use can be that the user has already increased the amplification by means of the volume control 73, so that the system, for example, is further capable of providing 10 dB extra amplification. If a sudden change in the undesired feedback path w increases the feedback by, e.g., 6 dB, the digital compensation circuit will perhaps not be able to neutralise this increase in the level in the feedback path, and the hearing aid will start to oscillate and will howl until the volume control 73 is screwed down or until the undesired feedback has been reduced. This problem and the consequences hereof can be removed or considerably reduced with the invention, in that the circuit 210 at different predetermined frequencies carries out an approximate calculation of the actual loop amplification, and multiplies this by the the setting of the volume control 73. If the result hereof is greater than a certain value, the amplification is reduced by means of the multiplication circuit 211 to a lower level in relation to that setting which the user has effected by means of the volume control 73. When the condition with the raised level in the undesired feedback path ceases or is reduced, the circuit 210 will take care that the hearing aid's amplification is adjusted up again, and is adjusted back to that level selected by the user if this is possible, i.e. the circuit 210 receives current information concerning the filter coefficients in the correlation circuit 31. The setting back will naturally take place in smaller steps, partly to avoid that the hearing aid starts to oscillate again, and partly in order to ensure that the regulation is noticeable by the user to the least possible degree.

At the same time that the amplification is reduced, the algorithm control circuit 79 will be coupled so that it functions in accordance with the so-called statistically safe algorithm.

If one expresses:

the setting of the volume control: vol, the loop amplification: Gain (FIRCOEF), a constant: K, which can be frequency-dependent, then:

$$\text{vol}\cdot\text{Gain (FIRCOEF)}>K \Rightarrow A<1$$

where A indicates that factor by which the digital circuit 211 multiplies.

The circuit's total open loop gain, i.e.:

$$\text{vol}\cdot\text{Gain (FIRCOEF)}\cdot A<1,$$

is continuously calculated and for selected frequencies, so that the digital circuit 210 constantly carries out the regulation of A.

I claim:

1. Hearing aid in which acoustic feedback between the transducer and the microphone is compensated for electronically by means of an electrical feedback signal produced using an adjustable digital filter, the coefficients of which are adjusted in accordance with actual acoustic feedback, and where a microphone signal is converted to digital signals which pass an amplitude limiting circuit arranged so as to prevent the transducer from entering a non-linear range, and where a digital noise signal from a digital noise generator and a digital compensation signal from a digital filter are added to the microphone signal to produce a composite signal, the composite signal being fed to a digital-to-analog converter to produce an analogue signal fed to the transducer via an amplifier, the hearing aid comprising:

a user-operated volume control to regulate amplification in the hearing aid via a second analog-to-digital converter:

a digital multiplication circuit in a digital signal path of the hearing aid between the analog-to-digital converter and the digital-to-analog converter;

an additional digital circuit coupled to the volume control and coupled to the digital filter to scan current filter coefficients and thereby calculate amplification of the digital filter, the additional digital circuit reducing multiplication in the digital multiplication circuit if the product of volume setting and calculated digital filter amplification exceeds a certain value, the certain value being constant or a function of frequency.

2. Hearing aid according to claim 1, further comprising an algorithm control circuit to monitor and control updating of the digital filter in accordance with at least one predetermined function and an input received from the additional digital circuit.

3. A hearing aid with electronic feedback compensation, comprising:

a transducer transmitting analog output signals;

a microphone generating analog input signals;

an analog-to-digital converter for converting the analog input signals produced by the microphone to microphone digital signals;

a filter for adding a digital compensating signal to the microphone digital signals so as to produce compensated microphone digital signals;

a volume control to regulate amplitude of the compensated microphone digital signals, thereby regulating amplification in the hearing aid;

a limiter to limit the compensated microphone digital signals below a predetermined level;

a digital noise generator to generate digital noise signals added to the limited compensated microphone digital signals to produce composite digital signals;

a digital-to-analog converter to convert the composite digital signals to analog output signals;

an amplifier to amplify the analog output signals before the analog output signals pass to the transducer;

a digital multiplication circuit connected between the analog-to-digital converter and the digital-to-analog converter;

a scanning digital circuit to receive an input from the volume control, coupled to the digital filter to scan current filter coefficients of the digital filter and to calculate amplification of the digital filter, the scanning digital circuit reducing multiplication in the digital multiplication circuit if a product of a volume setting of the volume control and calculated amplification exceeds a predetermined value, the predetermined value being a constant or a function of frequency.

* * * * *